US008459585B1

(12) United States Patent
Elder

(10) Patent No.: US 8,459,585 B1
(45) Date of Patent: Jun. 11, 2013

(54) WIRE TRANSPORT SYSTEM WITH IMPROVED RACKING RESISTANCE

(76) Inventor: Doyle Elder, Arapaho, OK (US)

( * ) Notice: Subject to any disclaimer, the term of this patent is extended or adjusted under 35 U.S.C. 154(b) by 158 days.

(21) Appl. No.: 12/553,699

(22) Filed: Sep. 3, 2009

(51) Int. Cl.
*B65H 75/40* (2006.01)

(52) U.S. Cl.
USPC ..... 242/403; 242/594.4; 242/594.6; 242/557

(58) Field of Classification Search
USPC ... 242/398, 403, 404, 590, 594, 594.2–594.6, 242/557
See application file for complete search history.

(56) References Cited

U.S. PATENT DOCUMENTS

| | | | | |
|---|---|---|---|---|
| D182,483 | S * | 4/1958 | Skinner | D34/21 |
| 4,605,237 | A | 8/1986 | Torgrimson | |
| 5,285,981 | A | 2/1994 | Pavelka | |
| 5,316,232 | A | 5/1994 | Lambert, Jr. | |
| 6,116,533 | A * | 9/2000 | Elder | 242/594.4 |
| 6,270,094 | B1 * | 8/2001 | Campbell | 280/47.19 |
| 6,422,504 | B1 | 7/2002 | Elder | |
| 6,523,776 | B1 * | 2/2003 | Elder | 242/594.4 |
| D491,330 | S | 6/2004 | Violo | |
| 6,951,316 | B1 | 10/2005 | Heidelberger | |
| 7,243,876 | B2 | 7/2007 | Robison | |
| D581,123 | S | 11/2008 | Henderson | |
| D584,471 | S | 1/2009 | Diedericks | |
| 7,784,729 | B1 * | 8/2010 | Hope | 242/557 |
| 2001/0030258 | A1 * | 10/2001 | Lenski et al. | 242/563.2 |
| 2009/0224498 | A1 * | 9/2009 | Diedericks | 280/79.6 |

* cited by examiner

*Primary Examiner* — Sang Kim
(74) *Attorney, Agent, or Firm* — James F. Harvey, III

(57) ABSTRACT

A transport system may be provided for transporting spools of flexible material, such as wire or tubing, about a construction site and for dispensing the material from a spool rotatingly mounted on an angled support of the transport system. The angled support may form an acute angle at its lower end with a central member of a mobile assembly and an acute angle at its upper end and a central member of an upper assembly, so that the angled support and central members are vertically coplanar along a longitudinal centerline of the transport system. In this manner, more spools of material may be carried between the extents of the central members than would be possible if the angled supports were perpendicular to the central members. Furthermore, the angled supports may resist racking forces resulting from longitudinal movement of the system and from resistance to dispensing of material from the spools.

18 Claims, 4 Drawing Sheets

WIRE TRANSPORT SYSTEM WITH IMPROVED RACKING RESISTANCE

BACKGROUND OF THE INVENTION

The present invention generally relates to methods and devices for transporting a multiplicity of wire spools and other elongate stock about a work site. More specifically, the present invention discloses a transport apparatus supporting one or more spools of flexible elongate material, so that each spool may be unrolled in the same direction and gathered in a bundle without deforming the transport system by their weight. The invention may be employed wherever it is desirable to dispense generally similar reeled materials, which may differ in certain aspects, such as dimensions, color, minor internal or external construction, and the like.

Construction electricians must typically have on hand many different types of electrical cables for a construction project. These types of cables may differ in many aspects. For example, different wire gauges are typically employed throughout a building. In large commercial, institutional, and industrial projects served by multiphase electrical supply systems, the various phases and neutral conductors are usually distinguished by color coding of the insulating jacket. Some applications require stranded conductors, while others require solid, single filament conductors. Therefore, a wide variety of electrical cables area are typically required in each construction project.

It is preferred to work with spools having a significant length of cable in order to avoid frequent depletion of a spool. Many electricians prefer to work with multiple spools each containing as much as 2,500 feet of cable. The cables are deployed to allow each cable to be unrolled in the same direction and optionally bundled together as a single wire run. As wire gauge increases, the various spools become correspondingly heavy. However, the force required pull the cables in the same direction may be exerted in a perpendicular direction against the upright standards that support the wire spools, so that the upright standards may be deformed longitudinally in the direction of pull. Eventually such strain may permanently bend the upright standards or cause them to fail. Furthermore, the inertia of the heavy wire spools may have the same effect when the wire cart is pushed about the work area.

The prior art has proposed carriages adapted to carry spools of wire and to make dispensing easy and practical. For example, U.S. Pat. No. 5,188,308, issued to Tussing on Feb. 23, 1993, describes a wire cart adapted to store a plurality of wire spools. The cart has a plurality of vertical posts from which branches project laterally. The spools are supported on the branches. Tussing discloses that the posts are vertically fixed in position on the cart. The posts rotate on the cart between a first position enabling easy loading of a spool onto a branch and a second position wherein wire is paid out in the same direction from which the spools are loaded. The supporting branches or rods of the present invention latch into place in the second position.

U.S. Pat. No. 5,316,232, issued to Lambert, Jr., on May 31, 1994, also describes a wire dispensing cart which carries spools of wire. The spools are supported on fixed horizontal rods on vertical supports. Rods supporting the spools rotate to enable easy loading of spools onto the rods.

A wire dispenser seen in U.S. Pat. No. 5,285,981, issued to Pavelka on Feb. 15, 1994, supports spools in one position. The device of Pavelka lacks ability to shift between first and second positions and to latch in one of the positions, as seen in the present invention.

U.S. Pat. No. 4,605,237, issued to Torgrimson on Aug. 12, 1986, describes a two wheeled wire dispensing carriage wherein spools are supported between the two wheels, which are quite large. The rods supporting the spools are fixed in position generally parallel to the axle. Torgrimson's device lacks the ability to shift between first and second positions, and to latch in one of the positions.

The inventor's prior patent (U.S. Pat. No. 6,422,504) discloses a wire spool cart for the transport of wire spools about a work site and dispensing of wire from the wire spools. The wire spools are supported on an angled spool rod support 30 that is in turn supported at its ends by a front post 24 and a rear post 28, which are oriented vertically. However, the front and rear posts may be subject to racking and deformation from their vertical position when the cart is urged into motion. Furthermore, the angled spool rod support may bow in the middle if it is weighted down by too heavy a spool load. The angled spool rod support enhances the ability of the wire spool cart to dispense wire simultaneously and is not directed to provide resistance to racking or supporting heavy loads.

When the number of spools becomes large, the weight of the spools on vertical supports may be significant so as to deform the supports when the cart is moved or when wire is pulled out from the spools against the resistance of the spools and posts. For example, commercial and industrial applications employ multi-wire cable bundles clad in various sheathing for different uses in buildings. Different types of wire bundles are frequently identified by their sheathing material, as, for example, MC (metal clad) cable, MI (mineral insulated) cable and AC (armored cable) among others. Use of these cladding materials along with wires having gauges of 12 and below result in wire spools that are excessively heavy for moving about the work site. Such wire spools may typically weigh between 100 lbs to 150 lbs, with average reel sizes of 24" in diameter and 14" in width. The larger spool sizes can typically go up to 24" wide and 30" in diameter with corresponding weight depending upon the type of cable and the cable length.

When spool sizes reach these weights and dimensions, a jack stand may be typically employed to support the spool for extraction of the cable held thereon. Such stands feature a horizontal axle that is inserted through the spool, whereupon the stand is tilted to lift the spool off the floor surface to allow it to rotate on the axle to dispense cable. Because of the bulk and weight of such spools, a single stand is employed for each spool. If the spools are to be moved to another location, they must be individually transported one by one to the new location and then reinstalled on the jack stand again.

As can be seen, there is a need for a transport system that may carry a plurality of spools simultaneously for a given size and that will be sturdy enough to resist racking force caused by inertia of the spools against the transport system when the transport system is urged into motion.

SUMMARY OF THE INVENTION

A system for transporting a plurality of spools of flexible elongate material is provided by the invention, which comprises a mobile assembly for moving the transport system about a surface; an upper assembly; and an angled support extending between the mobile assembly and the upper assembly, the angled support forming a first acute angle with the mobile assembly and a second acute angle with the upper assembly, the angled support maintaining the upper assembly a distance from the mobile assembly sufficient to support a spool of flexible material on the angled support therebetween for the dispensing of the flexible material.

More particularly, a transport system may be provided for the dispensing of a flexible elongate material wound about a spool and the movement thereof about a surface, where the transport system comprises a mobile assembly having (1) a lower central member extending along a longitudinal centerline of the transport system; a plurality of lower cross members, a single lower cross member attached to either end of the lower central member, each lower cross member being generally perpendicular to the lower central member; and a plurality of casters attached to and supporting the ends of two selected lower cross members for rolling contact with the surface, the casters are configured to permit the transport system to be moved in a direction of movement coincident with the longitudinal centerline while resisting movement in a direction that is perpendicular to the longitudinal centerline, the casters further adapted to permit the direction of movement to be changed through a pivoting movement about a selected caster; (2) an upper assembly with an upper central member extending along the longitudinal centerline and coplanar with the lower central member; and a plurality of upper cross members attached to and generally perpendicular to the upper central member; (3) an angled support extending between the lower central member and the upper central member, the angled support forming a first acute angle with the lower central member, the angled support forming with the upper central member a second acute angle equal in value with the first acute angle, the angled support maintaining the upper assembly a distance from the mobile assembly sufficient to position a spool of flexible material therebetween; and (4) an axle supported by the angled support; the axle oriented generally perpendicular with the upper central member and the lower central member so that flexible material from a spool mounted on the axle may be dispensed along the longitudinal centerline. The angled support may disposed to resist a racking force exerted by movement of the transport system in a direction coincident with the longitudinal centerline and also a racking force exerted by the dispensing of flexible material from a spool mounted on the axle while the transport system is at rest.

These and other features, aspects, and advantages of the present invention will become better understood with reference to the following drawings, description, and claims.

BRIEF DESCRIPTION OF THE DRAWINGS

FIG. 6 shows a typical axle, according to an embodiment of the invention.

DETAILED DESCRIPTION OF THE INVENTION

Figure 1:
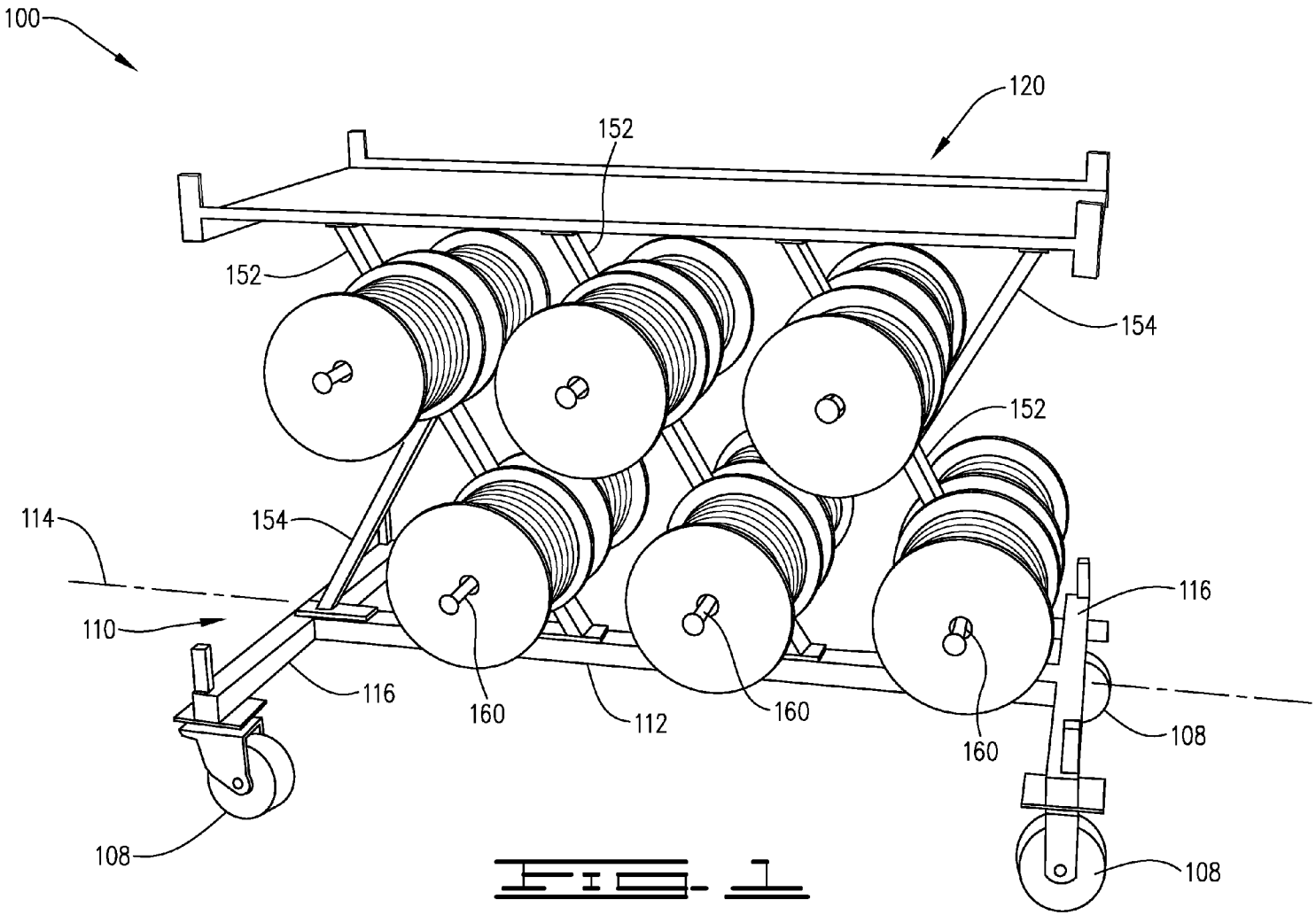
FIG. 1 shows a perspective view of a wire transport system having twelve equally sized spools of wire configured thereon, according to an embodiment of the invention.
Figure 2:
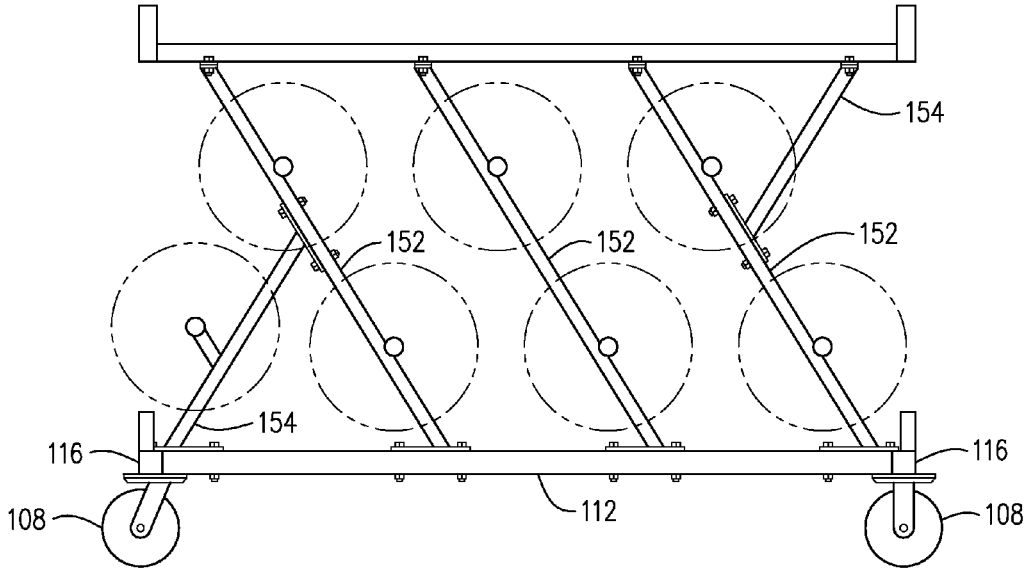
FIG. 2 shows a side plan view of a wire transport system configured for carrying an extra set of wire spools, according to an embodiment of the invention.
Figure 3:
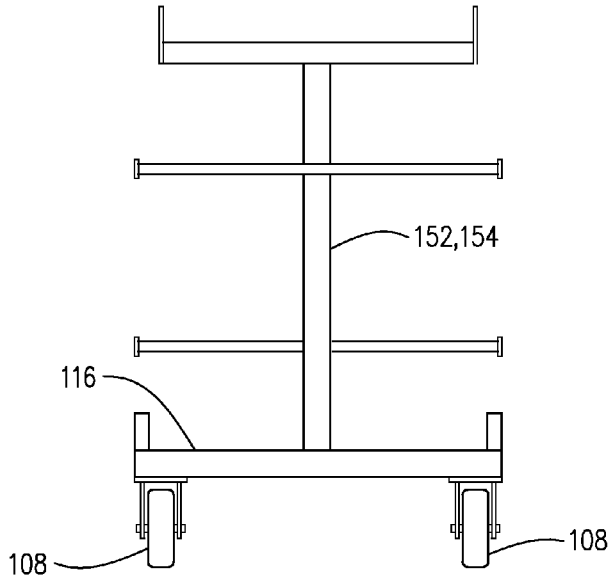
FIG. 3 shows an end plan view of the wire transport system of FIG. 2 to illustrate vertical spacing of the axles carrying spools, according to an embodiment of the invention.

The following detailed description is of the best currently contemplated modes of carrying out the invention. The description is not to be taken in a limiting sense, but is made merely for the purpose of illustrating the general principles of the invention, since the scope of the invention is best defined by the appended claims.

Broadly, the current invention includes systems, devices, and methods for providing a device for use in transporting wire spools or reels about a construction site. The device may comprise an upper assembly supported a vertical distance from a mobile assembly by one or more angled supports. Instead of being configured at vertical 90° position with respect to the mobile assembly and upper assembly, each angled support may form an acute angle with respect to the mobile assembly and/or the upper assembly. Although any acute angle between 10° and 89° may be configured, and the angle between a selected angled support and the mobile assembly or the upper assembly may be different from that formed by a different angled support. However, a practical choice for the acute angle may be a 60° angle for all angled supports.

The inertia of the transport system may increase with the added weight of numerous spools carried on axles attached to the angled supports. The angled supports may be aligned along a longitudinal centerline of the wire transport system that is coincident with the expected direction of motion. In this way, the angled supports may better resist a racking tendency of the wire transport system, i.e. inertia, when the wire transport system is moved from a position of rest into motion than if the angled supports were configured vertically. Furthermore, a transport system configured the angled supports may permit more wire spools to be carried between the extents of its mobile assembly and upper assembly, as compared with a transport system having vertical 90° supports. The angled supports may also be augmented by auxiliary supports connected between the angled support and either the mobile assembly or the upper assembly; the auxiliary supports may form a leg of a triangle, with portions of the angled support and assembly forming the other two legs. This arrangement forms a more efficient structure than bracing both sides of a vertically oriented support, in terms of economy of parts and material.

This inventive design of a transport device may permit the device to be easily packaged in an unassembled state in a relatively small, compact volume, where the package may be no longer than the central members extending the length of the device and no wider than the cross members comprising the width of the device. This may allow the device to be easily shipped and assembled on site. Furthermore, the device may be disassembled for storage rather than leaving it in an assembled state where it may take up valuable warehouse space.

A preferred application for the invention may be for electrical work being performed at construction sites, where an electrician may require many spools each having different types of electrical wires, cables, and/or flexible conduit. The angled supports may allow multiple strands of wire to be pulled from several spools mounted on the wire transport system. The racking resistance provided by the angled supports may also resist the pulling force exerted on the multiple strands of wire by a user who is pulling multiple strands from the spools. Other applications for the transport system may be for the transport of multiple coils of PEX (cross linked polyethylene) tubing by plumbing contractors about a work site, each coil consisting of different colors and/or gauges of tubing. The invention is equally applicable to dispensing of ribbons, filaments, and other material in industrial, commercial, and other settings where multiple gauges, colors, and/or sizes of the flexible elongate material must be made available for use at different work site locations.

Referring now to FIG. 1, a transport system 100 may be illustrated for the transport of multiple spools of elongate material about a work site. The transport system 100 may be comprised of a mobile assembly 110, an upper assembly 120, and one or more angled supports 154 therebetween holding the assemblies in a fixed, spaced relationship. One or more axles 160 may be transversely attached to an angled support 152 in a manner to be described presently, to form a generally right angle with the angled support 152 to which the axle 160 is attached. Each angled support 152 may have none, one, or multiple axles 160 attached thereon, depending upon the desired configuration. Auxiliary supports 154 may be provided to stabilize each angled support 152. Like the angled support 152, the auxiliary support 154 may form an acute angle with the mobile assembly 110 but opposite the acute angle formed by the angled support 152 and the mobile assembly 110. Auxiliary supports 154 may be used with each angled support 152 or selected angled supports 152 as desired, but typically an auxiliary support 154 may be attached at the bottom and top of the two outermost angled supports 154. In this context, the term "outermost" may reference a longitudinal centerline of the transport system 100 and may refer to the leading and trailing angled support along a direction of travel coincident with the longitudinal centerline. For stability in a longitudinal direction, it is preferable to have at least one such auxiliary support 154 configured to an angled support 152.

The mobile assembly 110 may provide an attachment point for lower ends of the angled supports 152. The mobile assembly 110 may be formed of a lower central member 112 extending along a longitudinal centerline 114, with each end of the lower central member 112 attached to center points of two lower cross members 116, respectively. Each lower cross member 116 may have a caster 108 attached to its ends, so that four casters 108 permit the mobile assembly 110 to be rolled along a surface. The casters 108 may be fixed or pivoted about central vertical axes; typically a pair of casters 108 attached to the same lower cross member 116 may be pivoted and a pair of casters 108 attached to the opposing lower cross member 116 may be fixed, in order to provide standard steering and movement of the transport system 100. However, any combination and arrangement of fixed and pivoted casters 108 may be used without departing from the scope of the invention.

Each angled support 152 may have a lower end and an upper end. The lower ends of one or more angled supports 152 may be attached to the lower central member 112. Attachment may be made either permanent or removable, as by bolts, screws, pins, or similar arrangements. Typically, attachment by means of bolts may be preferable in order to permit the transport system 100 to be shipped and arranged according to the user's desired configuration (i.e. number and sizes of wire spools.) A series of bolt holes may be provided in a top surface of the lower central member 112 for attachment of the lower ends of the angled supports 152. The lower ends may be regularly spaced or irregularly spaced at the user's option without departing from the scope of the invention, in order to provide maximum flexibility in configuring the transportation system 100 to the user's requirements.

Figure 7:
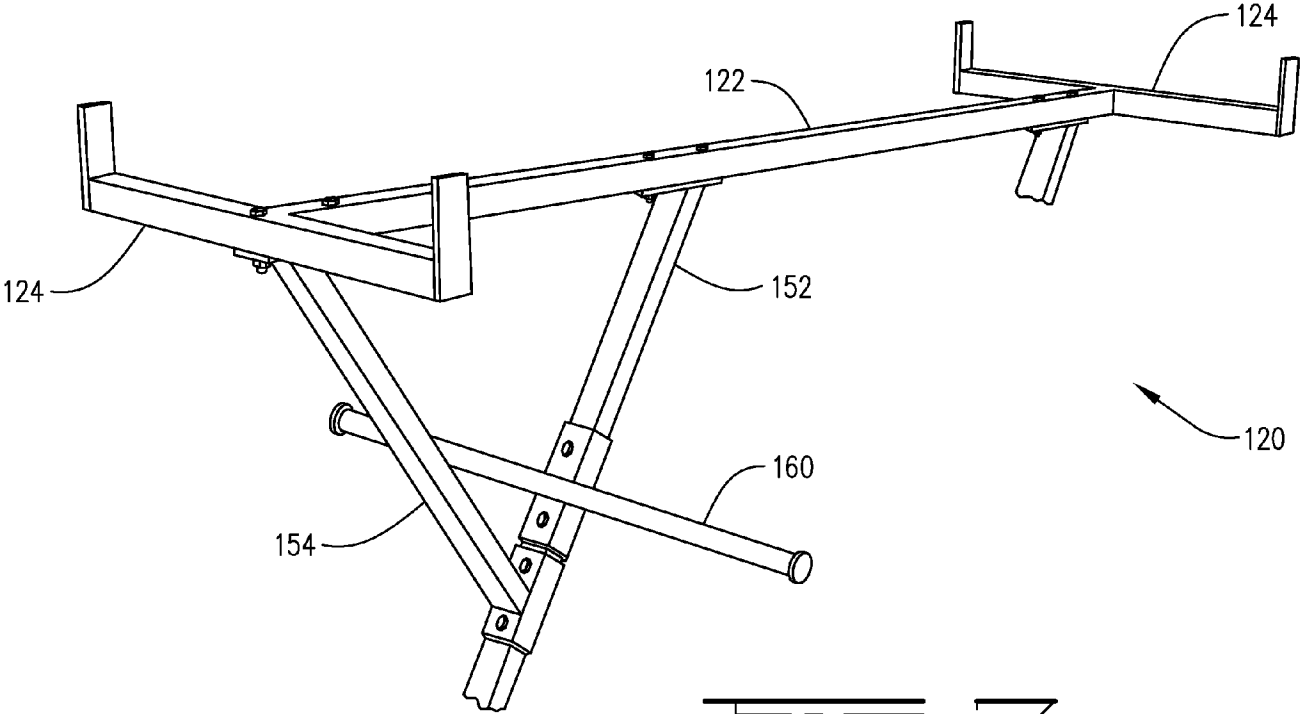
FIG. 7 shows a perspective view of an upper assembly without a horizontal surface, according to an embodiment of the invention.

Referring now to FIG. 7, the upper assembly 120 may be viewed without a horizontal surface attached thereto. The upper ends of the one or more angled supports 152 may be attached to an upper central member 122. To the ends of the upper central member 122 may be attached upper cross members 124 at their center points. The upper central member 122 may hold the angled supports 152 in alignment with the lower central member 112 and with each other, thereby providing stability to the structure.

Keepers 118 may be attached to the ends of the upper cross members 124 as another component of the upper assembly 120. Each keeper 118 may extend vertically a short distance from a point of attachment with the cross member 124, and serve to retain elongated items such as rigid pipes or conduit on the assembly for transport about the work site on the transport system. Preferably, the keepers 118 may be situated at the outermost ends of the cross member 124, so that up to four keepers 118 may be included in the transport system. The keepers 118 may be either removably attached to the ends by standard means such as bolts, screws, pins, and the like, or fixedly attached by standard means such as welding and the like. In some embodiments, keepers 118 may also be attached to the ends of the lower cross members in a similar arrangement.

The width of the transport system may be determined by the length of the cross members 116, 124, and may be chosen to allow the transport system to successfully negotiate standard door openings that may be encountered about the work site. Such standard door opening widths that are usually encountered may be 30", 32", or 36". Another determiner of transport system width may be the number of spools and the width of the spools that may be carried on a single axle. While these considerations are dictated by practicality on the work site, there may be no restriction or limitation on the width of the transport system.

Figure 4:
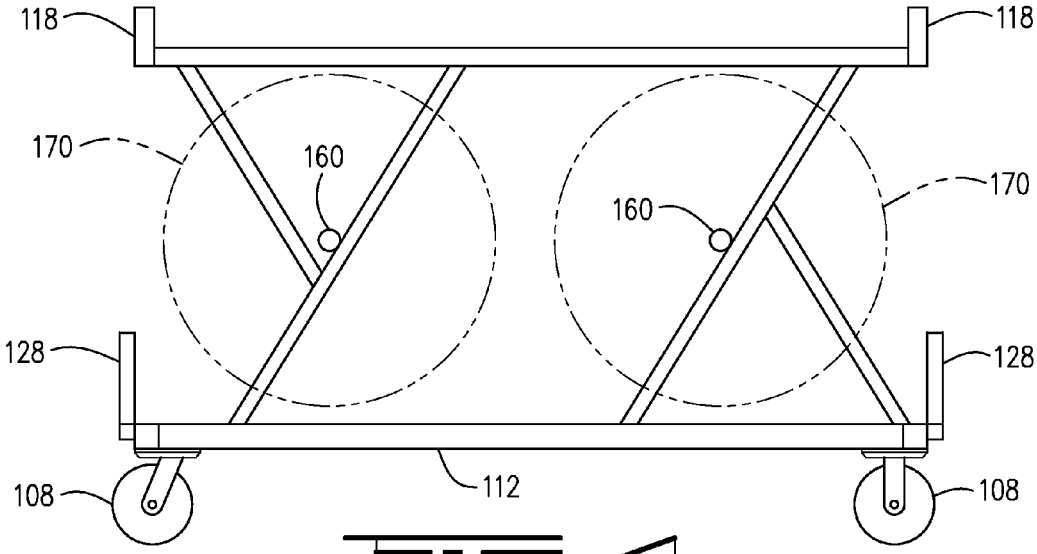
FIG. 4 shows a side plan view of a wire transport system configured to carry two or four large wire spools, according to an embodiment of the invention.
Figure 5:
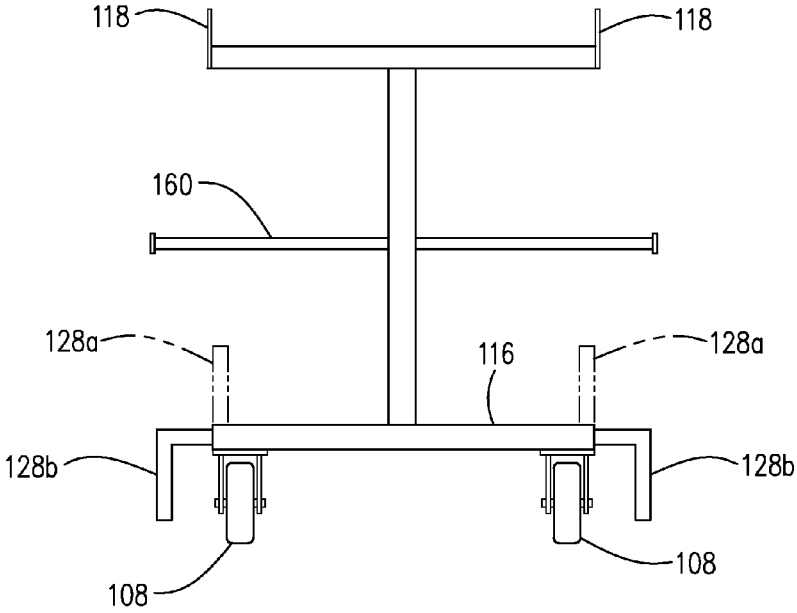
FIG. 5 shows an end plan view of the wire transport system of FIG. 4 to illustrate vertical spacing of the axles carrying spools, according to an embodiment of the invention.
Figure 5:
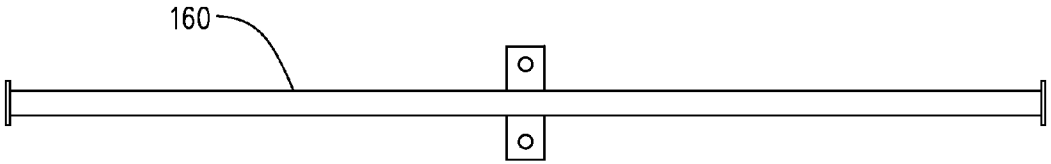

In a particular embodiment made by way of illustration and not of limitation, situations may arise where the large spools 170 attached to the axles 160 may be of such a thickness that they may extend laterally beyond the extent of the mobile assembly 110, thus necessitating an axle 160 that also extends laterally beyond the extent of the mobile assembly 110 (see FIGS. 4, 5, and 6). If a portion of the weight of such a large spool 170 is situated beyond the extent of the mobile assembly 160 (and thus the wheel base), the transport system may become laterally unstable, especially when negotiating turns, and the transport system may be prone to tipping. In this situation, outriggers 128 may installed on the ends of the lower cross members 116 as a safety feature.

As shown in FIGS. 4 and 5, the outrigger 128 may be implemented in the form of an "L", in which each arm of the "L" is of a different length. The cross member 116 may be configured to telescopically receive an arm of the "L" of the outrigger 128, where it may be secured by a removable pin inserted through a set of holes selected from a series of spaced sets of holes (not shown) that extend through both the arm and the cross member 116. The pins (not shown) may be secured to the assembly 110, 120 by means of short linked connectors in the vicinity of the holes or allowed to remain free. In this manner, the outrigger 128 may be made to extend beyond an edge of the mobile assembly 110 to accommodate large spools 170 that may be more bulky than those that can be accommodated within the boundaries of the assemblies 110, 120.

Each outrigger 128 may be stowed in a position as indicated in phantom as 128*a*, so that it extends upwardly away from the surface. When the outrigger 128 is deployed in an operable position as indicated by 128*b*, it may be pulled out of its telescoped stowed position and reversed to extend downwardly towards the surface so as to initially encounter the surface in the event of tipping. In this way, the outriggers 128 may provide a safety device to prevent the tool cart from overturning when larger-than-normal spools must be transported thereon. Optionally, the ends of the outriggers 128 may be configured with rubber stops, small wheels, or casters. The outriggers 128 may be telescopically stowed in a vertically upward orientation within the lower cross members 116 when they are not being employed.

With regards to the embodiment of the invention shown in FIGS. 4 and 5, it has been advantageously found that the angled structure of the angled supports 152 in conjunction with an auxiliary supports 154 may be sufficient to allow four large spools 170 to be supported on a single transport system 100, configured as at least a pair of tandem spools mounted on a single axle 160. Such a configuration may allow at least two large spools to be transported about a work site without having to dismount each spool, carry it individually to another location, and mount the spool for dispensing cable or wire. Several such pairs of tandem spools may be configured in a transport system 100 as one pair per angled support 152. The inventive structure of the transport system 100 has been found to be strong enough to resist racking of the transport system 100 when moving such large spools about the work site.

From the foregoing, it will be understood by persons skilled in the art that a transport system has been provided for the movement of spools of flexible materials, such as wire or tubing, about a work site, and also to carry accompanying rigid elongate material associated thereto. The invention is relatively simple and easy to manufacture, yet affords a variety of uses. While the description contains many specifics, these should not be construed as limitations on the scope of the invention, but rather as an exemplification of the preferred embodiments thereof. The foregoing is considered as illustrative only of the principles of the invention. Further, because numerous modifications and changes will readily occur to those skilled in the art, it is not desired to limit the invention to the exact construction and operation shown and described, and accordingly all suitable modifications and equivalents may be resorted to, falling within the scope of the invention. Although this invention has been described in its preferred form with a certain degree of particularity, it is understood that the present disclosure of the preferred form has been made only by way of example and numerous changes in the details of construction and combination and arrangement of parts may be resorted to without departing from the spirit and scope of the invention.

I claim:

1. A transport system for a spool of a flexible elongate material, the transport system having a longitudinal centerline and comprising:

a mobile assembly for moving the transport system about a surface in a direction of travel that is aligned with the longitudinal centerline, the mobile assembly having a lower central member;

an upper assembly having an upper central member;

an angled support extending between the mobile assembly and the upper assembly and coplanar with the longitudinal centerline, the angled support having a lower end attached to the mobile assembly to form a first acute therewith, the angled support having an upper end attached to the upper assembly to form a second acute angle therewith, the angled support maintaining the upper assembly a distance from the mobile assembly;

an auxiliary support having a third end and a fourth end, the third end connected to the angled support and the fourth end connected to a member selected from the group consisting of the upper central member and the lower central member, the auxiliary support being coplanar with the upper central member, the lower central member, and the angled support; and an axle with an inner axle end and an outer axle end, the inner axle end attached to the angled support a first distance from the lower end of the angled support and a second distance from the upper end of the angled support, the first distance and the second distance each greater than a radius of the spool that is received by the outer axle end for rotational movement thereabout.

2. The transport system described in claim 1, wherein the lower central member extends along a longitudinal centerline of the transport system, the lower central member having two lower cross members attached to either end thereof which are perpendicular to the lower central member, the ends of each lower cross member supported by a caster attached thereto for rolling contact with the surface.

3. The transport system described in claim 2, wherein the elongate flexible material is dispensed in a direction that is generally parallel to the longitudinal centerline.

4. The transport system described in claim 2, wherein the casters are configured to permit the transport system to be moved in a direction of movement coincident with the longitudinal centerline while resisting movement in a direction that is perpendicular to the longitudinal centerline, the casters further adapted to permit the direction of movement to be changed through a rotational movement about a selected caster.

5. The transport system described in claim 2, wherein the upper central member extends along a longitudinal centerline of the transport system, the upper central member having two upper cross members attached to either end thereof each of which are generally perpendicular to the upper central member.

6. The transport system described in claim 1, wherein plane of the upper central memberthe lower central member, and the angled support is vertical.

7. The transport system described in claim 1, wherein the auxiliary support forms a third acute angle with the selected member, the third acute angle having the same value as the first acute angle.

8. The transport system described in claim 1, further comprising a horizontal surface supported by the upper assembly.

9. The transport system described in claim 1, further comprising an outrigger vertically extending from an end of a lower cross member.

10. The transport system described in claim 9, wherein the outrigger telescopically extends from the lower cross member.

11. A transport system for the dispensing of a flexible elongate material wound about a spool and the movement thereof about a surface, the transport system comprising a mobile assembly further comprising a lower central member extending along a longitudinal centerline of the transport system;

a plurality of lower cross members, a single lower cross member attached to either end of the lower central member, each lower cross member being generally perpendicular to the lower central member; and a plurality of casters attached to and supporting the ends of two selected lower cross members for rolling contact with the surface, the casters are configured to permit the transport system to be moved in a direction of movement coincident with the longitudinal centerline while resisting movement in a direction that is perpendicular to the longitudinal centerline, the casters further adapted to permit the direction of movement to be changed through a pivoting movement about a selected caster;

an upper assembly comprising an upper central member extending along the longitudinal centerline and coplanar with the lower central member; and a plurality of upper cross members attached to and generally perpendicular to the upper central member;

a first angled support and a second angled support, each angled support extending between the lower central member and the upper central member and coplanar with the upper central member and the lower central member, each angled support forming a first acute angle with the lower central member, each angled support forming with the upper central member a second acute angle equal in value with the first acute angle, the angled support maintaining the upper assembly a distance from the mobile assembly sufficient to position a spool of flexible material therebetween;

a first auxiliary support connected between the first angled support and a first selected member selected from a group consisting of the upper central member and the lower central member, wherein the first angled support has an axle mounted thereto at about a midpoint of the first angled support for support of a large wire spool on each end of the axle; and an axle with an inner axle end and an outer axle end, the inner axle end attached to the angled support; the axle oriented generally perpendicular with the upper central member and the lower central member so that flexible material from a spool mounted on the axle may be dispensed along the longitudinal centerline.

12. The transport system described in claim 11, further comprising a first lower cross member with a first centerpoint is attached to a first end of the lower central member generally at the first centerpoint;

a second lower cross member with a second centerpoint is attached to a second end of the lower central member generally at the second centerpoint;

a first upper cross member with a first centerpoint is attached to a first end of the upper central member generally at the first centerpoint; and a second upper cross member with a second centerpoint is attached to a second end of the upper central member generally at the second centerpoint.

13. The transport system described in claim 12, wherein a selected upper cross member has a keeper vertically extending from an end thereof.

14. The transport system described in claim 12, wherein each lower cross member has an outrigger having an L-shape with unequal arms each of which are adapted for telescopic insertion into an end of the lower cross member, the uninserted arm selectively extending upwardly in a vertical direction and downwardly in a vertical direction without encountering the surface.

15. The transport system described in claim 12, further comprising four casters, wherein each caster is attached to an end of a lower cross member.

16. The transport system described in claim 12, further comprising a horizontal surface supported by the upper assembly.

17. The transport system described in claim 11, further comprising a second angled support and a second auxiliary support connected between and the second angled support and a second selected member selected from the group consisting of the lower central member and the upper central member, the second selected member being different from the first selected member;

wherein the second angled support has an axle mounted thereto at about a midpoint of the angled support for support of a large wire spool on each end of the axle.

18. The transport system described in claim 11, wherein two collinear axles are replaced by a long axle connected to the angled support at a midpoint of the long axle.

* * * * *